United States Patent [19]

Ogden

[11] 4,108,931

[45] Aug. 22, 1978

[54] SYSTEM OF MAKING MOLDS FOR INVESTMENT CASTING

[76] Inventor: Ralph Ogden, 1304 Fisher St., Munster, Ind. 46321

[21] Appl. No.: 716,514

[22] Filed: Aug. 23, 1976

Related U.S. Application Data

[63] Continuation of Ser. No. 541,230, Jan. 15, 1975, abandoned.

[51] Int. Cl.[2] ..... B29C 1/02; B29C 29/00

[52] U.S. Cl. ..... 264/37; 106/38.2; 106/38.25; 106/38.28; 164/36; 164/41; 164/43; 264/221; 264/DIG. 44; 264/DIG. 51

[58] Field of Search ..... 264/221, 37, 317, 56, 264/DIG. 44; 164/34, 35, 36, 41, 43, 44, 45, 5; 106/38.25, 38.28, 38.8, 272, 38.2

[56] References Cited

U.S. PATENT DOCUMENTS

| | | | |
|---|---|---|---|
| 2,420,851 | 5/1947 | Zahn et al. | 164/35 |
| 2,886,869 | 5/1959 | Webb et al. | 106/38.25 |
| 3,094,751 | 6/1963 | Horton | 164/36 |
| 3,884,708 | 5/1975 | Burkert | 106/38.8 |

FOREIGN PATENT DOCUMENTS

| | | | |
|---|---|---|---|
| 1,944,632 | 3/1971 | Fed. Rep. of Germany | 252/29 |

*Primary Examiner*—James B. Lowe
*Attorney, Agent, or Firm*—McWilliams & Mann

[57] ABSTRACT

A system of making molds for investment casting in which the patterns are formed from, and the sprue form is coated with, polyethylene glycol having a molecular weight in the range of from approximately 1,300 to approximately 1,600, or its equivalent and having admixed therein as a filler powdered graphite, in which the graphite comprises in the range of from about 35 per cent to 60 per cent by weight of the pattern forming material. The patterns are molded to the desired shape, and to include a gate section, and they are adhered to the sprue form in spaced apart relation by fluidizing the gate section end to make a welded connection with the sprue form coating. The mold is then formed about the patterns that are adhered to the sprue form, leaving the pour cup end of the sprue form exposed, to which heat is subsequently applied to sufficiently fluidize the sprue form coating so that the sprue form can be drawn out of the mold thereby leaving the sprue opening. The sprue form coating remaining in the mold sprue and the patterns are then removed without heating the mold by leaching with water, utilizing mechanical and/or chemical agitating after which the mold may be heated sufficiently to dry same for use as an investment casting mold.

12 Claims, 12 Drawing Figures

SYSTEM OF MAKING MOLDS FOR INVESTMENT CASTING

This application is a continuation of my application Ser. No. 541,230, filed Jan. 15, 1975 now abandoned.

This invention relates to a system of making molds for investment casting, and more particularly, to a pattern forming material and method of procedure utilizing same for making investment casting molds.

In the art of investment casting, the mold in which the product is cast is produced by surrounding an expendable pattern with a refractory material that sets at room temperature. The pattern, which conventionally is in the form of a wax or resinous plastic material, is then melted or burned out of the mold, leaving the mold cavity that receives the hot metal from which the final product is formed. After the cast metal is cooled, the mold is broken away from the product.

The investment casting mold itself is formed in a suitable pattern die.

As is well known in the art, two distinct general procedures are employed in mold preparation, namely the shell investment process and the solid investment process.

In the shell investment process, after the pattern assembly is made, it is alternately dipped in a coating slurry and stuccoed with granulated refractory either by sprinkling or by suspending in a fluidized bed, until the shell is built up to the desired thickness. Usually the refractory grain ranges in the size from twenty to one hundred mesh, the fine material being used for the initial cost and progressively coarser grains for subsequent coats. Each coat of slurry and grain is air dried before subsequent coats are applied.

In the solid investment process, the pattern assembly is encircled by a flask or other container, which in turn is filled with a refractory mold slurry. The mold slurry hardens to form a solid mass in which the pattern assembly is encased.

In either case, after formation of the mold, the patterns that have been embedded in the mold, which conventionally, as has been indicated, have been formed from wax or a suitable synthetic resin material, are melted or burned out of the mold to remove same, utilizing procedures requiring heating of the mold.

The removal of the pattern material from investment casting molds has long presented difficulties in this art. One factor involved is that the coefficient of thermal expansion of conventional pattern forming materials is much greater than the mold investment material in which the patterns are encased. The result is that as heat is applied to the mold to melt or burn out the pattern material, the pattern increases in volume more rapidly than the mold, and the differences in expansion between the pattern material and the mold investment material can generate pressure sufficient to break or crack the mold.

In the case of shell investment molding, another factor is that the ceramic materials conventionally employed are quite brittle, and the common methods of de-waxing such molds (where wax is employed) are of the autoclave and furnace type, both of which subject the shell to a large thermal gradient across its thickness. It has become common practice to therefore use shell materials that have a low coefficient of thermal expansion since otherwise the shell would fracture, such materials being fused silica, zircon silicates, and aluminum silicates, which are relatively expensive. High purity quartz, on the other hand, is not only an excellent refractory material, but it is relatively inexpensive; however, its relatively high coefficient of thermal expansion would cause an unacceptable amount of shell breakage during the conventional de-waxing cycle, which, as indicated, requires the mold to be subjected to a large thermal gradient across its thickness.

A principal object of this invention is to provide a pattern forming material and method of procedure for making investment casting molds in which no heating of the mold is required until after the pattern material is removed from the mold.

Another principal object of the invention is to provide a pattern forming material that has high thermal conductivity for rapid molding procedures, good lubricity for removal from the pattern forming mold, avoids pattern cracking tendencies, is surface wettable at room temperatures using water, has a low coefficient of expansion, and is chemically inert.

Another principal object of the invention is to provide a system of making investment casting molds in which the pattern material is fully removed from the mold without heating by leaching, and at room temperature, the pattern material out of the mold, utilizing water for this purpose.

Another object of the invention is to provide a system of making investment casting molds permitting the use of cheaper refractory mold forming materials and thinner investment shells, to provide a pattern forming material and leaching procedure that permits recovery and re-use of substantially all of the pattern material employed, and to provide a system of making investment casting molds that is economical and reliable in operation, that eliminates pattern removal as a strength design factor for the mold shell, and that is applicable to the making of a wide variety of products by investment casting procedures.

In accordance with the invention, the patterns are formed from, and the sprue form is coated with polyethylene glycol having a molecular weight which preferably is in the range from approximately 1,300 to approximately 1,600, or comprises a mixture of this material and higher molecular weight polyethylene glycols that provides equivalent characteristics, and having admixed therein as a filler powdered graphite, in which the graphite comprises in the range of from about 35 percent to about 60 percent of the pattern forming material by weight.

The patterns are suitably formed by employing conventional molding procedures, to the desired shape, and to include a gate section, with the patterns being adhered in groups, in spaced apart relation, to the sprue form by fluidizing the gate section end to make a welded connection with the sprue form coating, thereby forming the pattern assembly.

The investment mold is then formed about the resulting pattern assembly, including the sprue form, leaving the pour cup end of the sprue form exposed, to which heat is subsequently applied to sufficiently fluidize the sprue form coating so that the sprue form can be readily moved by sliding it out of the resulting mold and pattern assembly.

The sprue form coatings remaining in the mold sprue, and the invested patterns, are then removed without heating the mold by leaching with agitated water; the water agitation may be done mechanically by repeatedly inserting and removing the mold assembly into and out of a water bath in such a manner that the water readily courses into and out of the mold assembly through the sprue. As the material from which the patterns and sprue coatings are formed has a solubility of approximately 70 grams in 100 cubic centimeters of water at 68° F., the moving water effects a rapid leaching out of the pattern and sprue form coating material from the mold by employing a water bath dipping and removal procedure of the type indicated.

The leaching action may be assisted by incorporating into the pattern forming material sodium carbonate, or other suitable carbonate, and maintaining the leaching water under acidic conditions, which results in a chemically induced scrubbing action at the surface of the patterns, resulting from the release of gaseous carbon dioxide.

After the removal of the pattern material from the mold has been completed, the molds are rinsed in fresh water and dried in an oven to complete the mold forming procedure. Pre-heating of the molds and the casting of metal in them may then take place in a conventional manner.

The mold forming method of this invention permits the use of the cheaper refractory materials available for making molds, such as the high purity quartz that has been referred to. Since the leaching procedure contemplated by the invention removes all of the pattern material from the mold, there is no residue left that needs to be burned out when the molds are preheated prior to use for casting. For this reason the temperature of preheating need not be higher than required for the casting procedures, with corresponding reduction in stress due to thermal gradients across the thickness of the mold.

In addition, the pattern forming material and its filler can be reclaimed for repeated usage by driving off the leaching water, utilizing evaporation procedures of a conventional type.

Furthermore, the thickness of the mold, in practicing the invention in connection with shell investment molding, may be determined without reference to removal of the pattern material from the mold.

Other ojects, uses and advantages will be obvious or become apparent from a consideration of the following detailed description and the application drawings.

Figure 4:
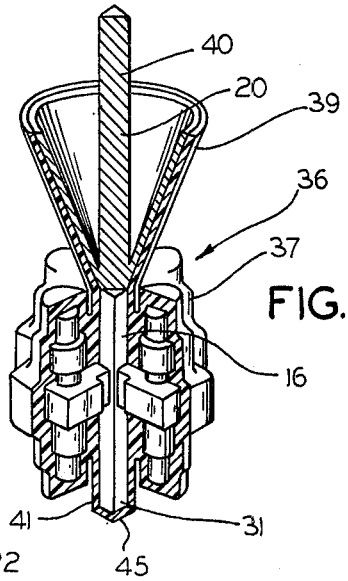
FIG. 4 is a diagrammatic perspective view similar to that of FIG. 1 illustrating the mold as completed with the sprue form and patterns still in place.
Figure 5:
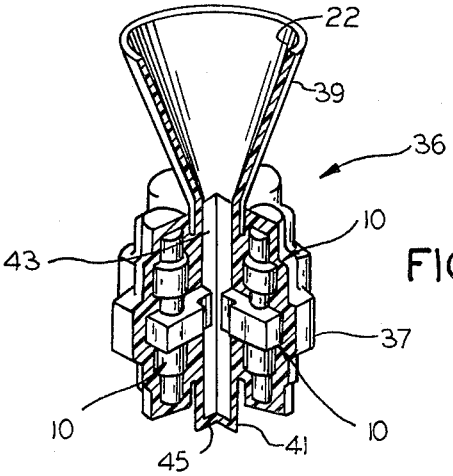
FIG. 5 is similar to that of FIG. 4, but showing the sprue form having been removed for application of the pattern material leaching water to the mold.
Figure 6:
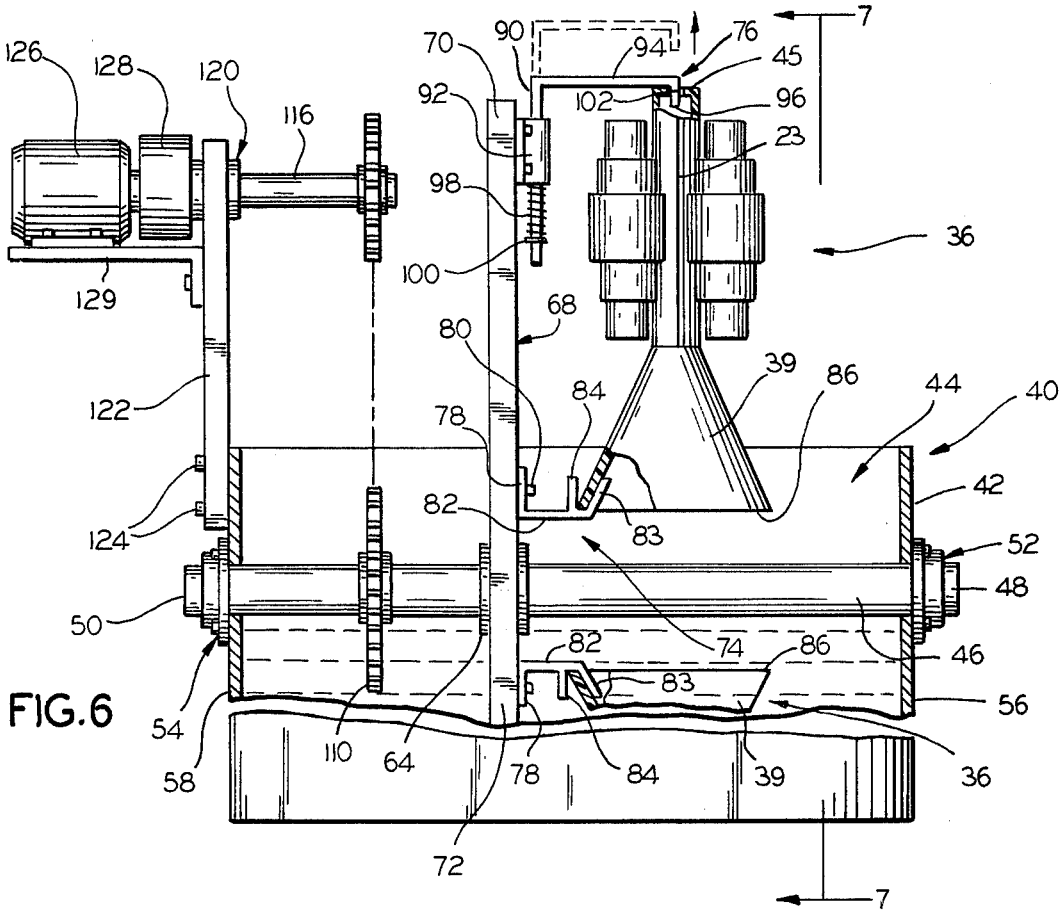
Figure 7:
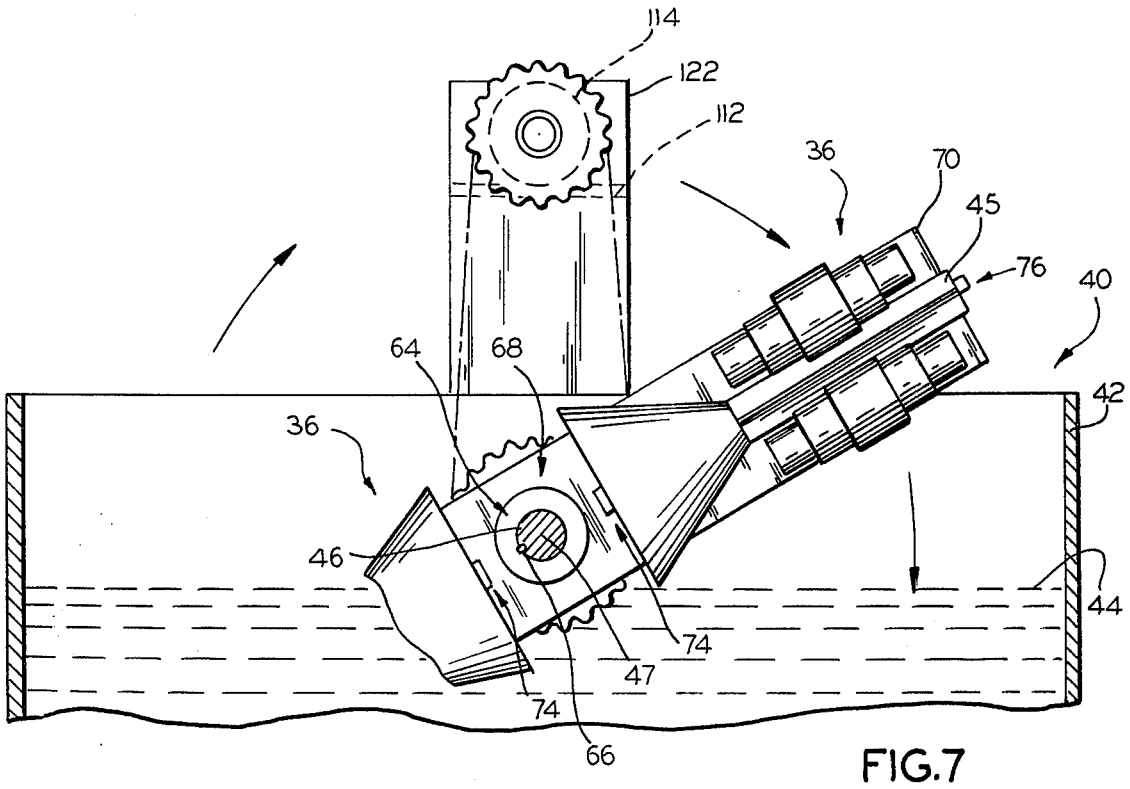
Figure 8:
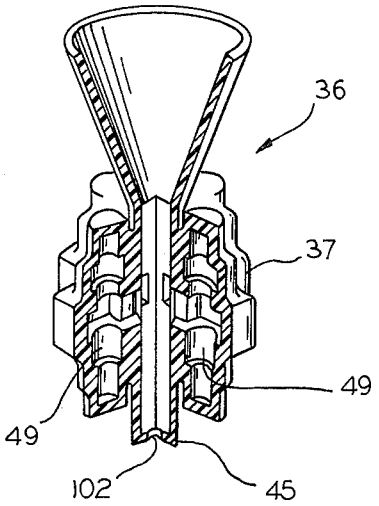
Figure 9:
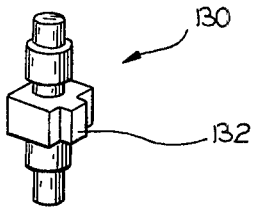
Figure 10:
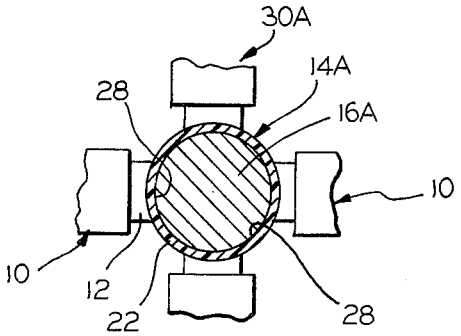
Figure 11:
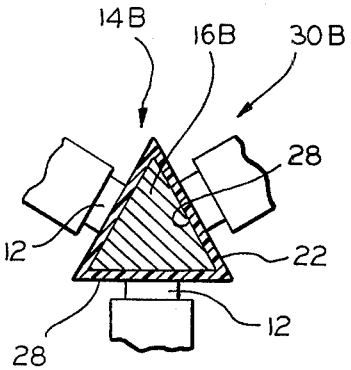
Figure 12:
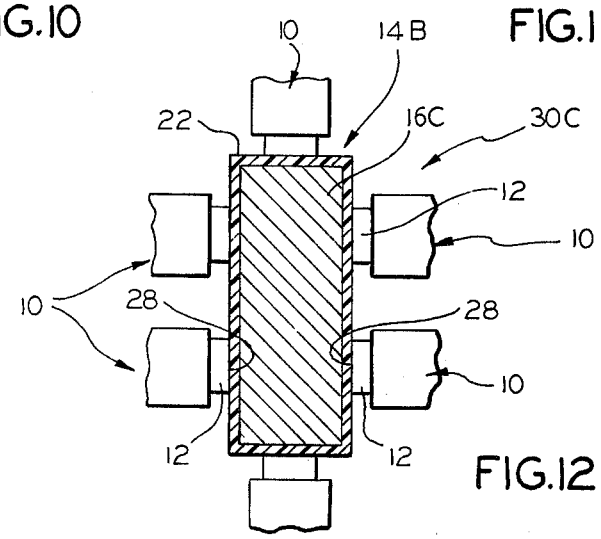

FIG. 6 diagrammatically illustrates one way of leaching the pattern material from the mold, in accordance with this invention, utilizing a water bath;

FIG. 7 is a diagrammatic view taken substantially along line 7—7 of FIG. 6;

FIG. 8 is a view similar to that of FIGS. 4 and 5, but illustrating the mold after complete removal of the pattern forming material, with the mold being shown in pouring position;

FIG. 9 diagrammatically illustrates one of the four castings made by utilizing the mold of FIG. 8, after the casting has been removed from the mold; and FIGS. 10, 11, and 12 are transverse cross-sectional views through varient shapes of pattern assemblies utilizing variant sprue form shapes.

However, it will be understood that the details herein described and illustrated are intended to be merely illustrative in character, and that the invention is susceptible of other embodiments that will be obvious to those skilled in the art, without departure from the spirit and scope of the invention as expressed in the appended claims.

GENERAL DESCRIPTION

In accordance with the invention, the basic material to form the patterns and coat the sprue form comprises polyethylene glycol that preferably has a molecular weight lying in the range from approximately 1,300 to approximately 1,600 and having the generalized formula $HOCH_2(CH_2OCH_2)_NCH_2OH$, in which N represents the average number of Oxyethylene groups. This material, which is commercially available, has a solubility in water to the extent that 70 grams of the material may be dissolved in 100 cc's of water at 68° F., and has a viscosity at 210° F. of 25 to 32 centistrokes, an ethoxyl content of 22 to 48 moles, and a solidification range of 43 to 46° C. An example of a commercially available form of this material is the Carbowax 1540 product made and sold by Union Carbide Corporation.

Further in accordance with the invention, the polyethylene glycol material includes a filler of powdered graphite of which 35 percent of the graphite is of 200 mesh size and 65 percent of the graphite is of 35 mesh size. Where it is desired to have, on leaching out of the pattern forming material, a chemically induced water agitation action (as hereinafter explained), the pattern forming material includes a small amount of a suitable carbonate, such as calcium carbonate, in the amount of approximately 1–5 percent by weight.

The pattern forming material is formulated by heating the commercially available polyethylene glycol to approximately 200 degrees F. and then mixing into the melted polyethylene glycol the graphite material to the extent that the graphite material will be in the range of from approximately 35 to approximately 60 percent of the mixture by weight. In a preferred embodiment, the polyethylene glycol and the graphite are in approximately equal amounts by weight.

The mixture is suitably agitated using conventional means to insure that the graphite is well distributed throughout the polyethylene glycol. The carbonate material (where employed), which should be finely ground, is then added and thoroughly mixed in to insure that it also is well distributed.

The individual patterns are formed by applying the indicated polyethylene glycol mixture to suitably formed molds. One way of doing this is to use injection molding techniques whereby conventional injection molding equipment is employed to inject the pattern forming material into a suitably formed metal mold, while at a temperature in the range of from approximately 130° F. to approximately 150° F., depending on the amount of graphite employed in the mixture and the complexity of the shape being molded. Mixtures including higher percentages of graphite and patterns of some significant amount of complexity require the higher temperature of heating for injection molding purposes.

Following conventional procedures, the pattern forming compound should be kept agitated during injection molding, using conventional equipment, to keep the graphite (and carbonate material, where employed) uniformly dispersed throughout the compound.

In this connection, it is pointed out that the graphite particle size proportioning indicated is preferred to insure adequate smaller graphite size particles for accurate detail formation, and adequate larger sized graphite particle content to insure adequate introduction of graphite material into the mixture per unit of mixture.

The graphite content of the pattern forming compound in accordance with this invention is important for a number of reasons. For instance, the graphite significantly increases the heat transfer capability of the polyethylene glycol so that injection molding cycle times can be speeded up to four or five times the cycle times utilizing wax or polyethylene glycol alone. Furthermore, the graphite adds significant lubricity to the pattern forming compound, which facilitates removal of the pattern from the injection molds without the use of mold release agents.

Furthermore, graphite has a low coefficient of thermal expansion and its addition to the polyethylene glycol decreases the coefficient of thermal expansion of the latter material by a significant amount. Graphite is also chemically inert and it is wettable by the water based slurries used in forming face coats on the shell. Also of significance is that graphite is a low cost material.

The graphite also imparts stiffness to the patterns, and eliminates cracking tendencies of unfilled polyethylene glycol.

Figure 1:
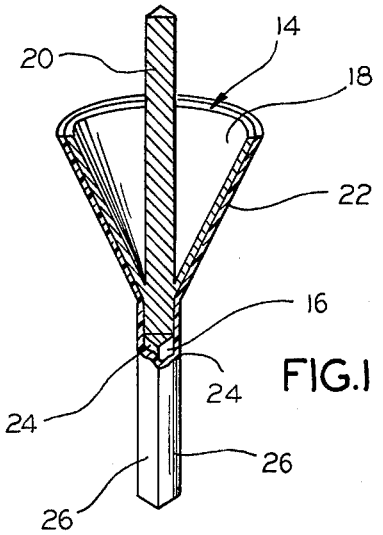
FIG. 1 is a diagrammatic perspective view, partially in section, illustrating the sprue form employed in connection with the invention and the application thereto of the sprue form coating by which the individual patterns are secured to the sprue form to form the pattern assembly, and by which the sprue form is made removable after formation of the mold.
Figure 2:
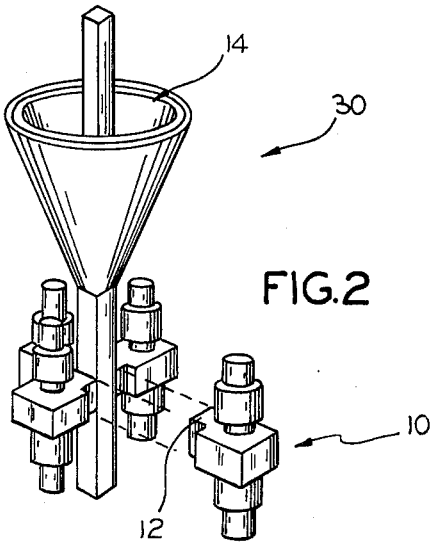
FIG. 2 is similar to FIG. 1, but illustrates the manner of applying the individual patterns to the coated sprue form.

FIG. 2 illustrates a plurality of patterns 10 that are assumed to be formed in accordance with the invention, from the pattern forming compound that has been described utilizing conventional injection molding materials. The patterns 10 are thus exact duplicates of a component to be made utilizing investment casting procedures in accordance with this invention, with the individual patterns 10 also each including a gate stub or section 12 (as is conventional). Patterns 10, of course, are intended to represent any shape of mold pattern for which investment casting is adapted, the specific shaping shown being illustrative only.

Further in accordance with the invention, sprue form 14 is employed to which a group of the patterns 10 are to be secured to form the pattern assembly about which the investment casting mold is formed.

In accordance with this invention, the sprue form 14 generally comprises a casting formed from the heat conductive material such as aluminum defining an elongate shank 16 which has integral therewith an encompassing flange portion 18 of frusto-conical configuration, through which projects shank extension 20 that forms the handle of the sprue form 14.

The sprue form 14, in accordance with this invention, has its shank 16 and flange 18 externally coated with a layer or coating 22 of the same material from which the individual patterns 10 are formed, which may be done by dipping the sprue form into a bath of the pattern form material in liquid form. The dipping action employed may be repeated as desired to build up the thickness of the coating 22 to a thickness of approximately 1/16th of an inch.

In the sprue form shown in the showings of FIGS. 1–8, the shank 16 of the sprue form is of square transverse cross-sectional configuration, so that the sprue form shank 16 defines four faces or surfaces 24 that when covered with the coating or layer 22, define pattern attachment surfaces 26 to which the individual patterns are applied in the manner indicated in FIG. 2 to form the pattern assembly 30. This is done by fluidizing in any suitable manner the end faces 28 of the pattern gate sections 12, as by heating them or moistening them, with electrically heated knives, plates or irons, and then bringing the individual fluidized faces 28 to bear against the respective pattern form surfaces 26 and permitting the fluidized material to harden, so that a welded connection is made between the individual patterns and the pattern form by a bonding together of the material forming the individual pattern gates 12 and the sprue form layer 22 along the respective sprue form surfaces 26.

As is conventional, the patterns 10 are applied to the sprue form at an identical spacing from the end 31 of the sprue form (see FIG. 4) so that the patterns will be level with one another on the sprue form, and, of course, equally spaced about the sprue form.

Alternate shapes of sprue forms are shown in FIGS. 10–12. In FIG. 10 the shank 16A of sprue form 14A is round in transverse section, while in FIGS. 11 and 12 the shanks 16B and 16C of the respective sprue forms 14B and 14C are respectively triangular and rectangular in transverse section. In any of these forms the fluidized faces 28 of the respective pattern gate sections 12 are pressed into firm engagement during the welding process, and readily conform in each case to the specific shape of the sprue form shank involved. The result are the variant forms of pattern assemblies 30A, 30B, and 30C of FIGS. 10–12.

Assuming that the mold is to be of the shell type, the making of the shell mold then proceeds in a suitable conventional manner. The pattern assembly, for instance, assembly 30, is dipped into a slurry containing suitable ceramic powders and a suitable binding agent suspended in a liquid, up to the level that suitably covers the patterns 10, and sprue form coating 22, after which the pattern assembly is withdrawn from the slurry, permitted to drain, and then the wetted surfaces stuccoed with a dry refractory grain, either by sprinkling or by immersion in a fluidized bed, after which the resulting assembly coating is dried. This process is repeated until the required mold thickness is achieved. The initial coating is termed a face-coat, and following customary procedures, will employ a slurry that is made of finely ground particles to provide a smooth surface. Subsequent coatings usually contain increasingly coarser refractory grains.

Figure 3:
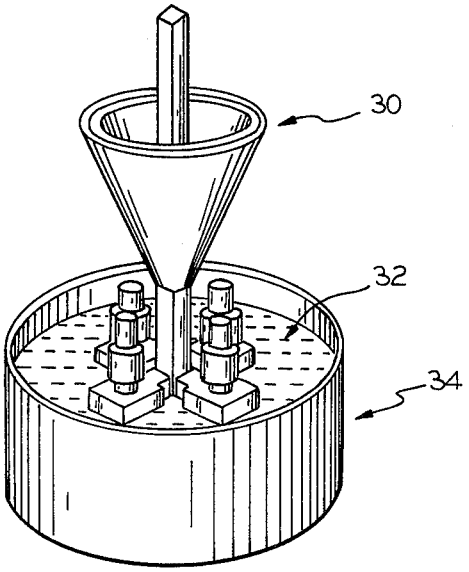
FIG. 3 is similar to that of FIGS. 1 and 2 but illustrating the application of the pattern assembly to a ceramic slurry bath for forming a shell type mold.

In FIG. 3, the mold forming procedure is illustrated diagrammatically, with the slurry 32 being shown contained in suitable container 34, with it being understood that the pattern assembly 30 is suitably moved vertically to dip it into and remove it from the slurry 32 in accordance with conventional practices.

For practicing the present invention, the conventional step of dipping the pattern assembly into a wetting agent, prior to dipping in the ceramic slurry, in order to condition the surfaces of the patterns 10 and coating 22 for adherence of the slurry, is not necessary. This is necessary in connection with wax or resinous plastic patterns as the slurry will not adhere or wet their surfaces without thorough cleaning and etching in a solvent. It is also necessary to add wetting agents to the slurry where wax or plastic patterns are involved, which also is not necessary in practicing this invention.

As the material for forming patterns 10 and coating 22, in accordance with the present invention is both wettable and soluble in water and other liquids conventionally used in such slurries, it is not necessary to either etch the patterns or add wetting agents to the slurries.

The resulting shell mold is indicated at 36 in FIG. 4. While any suitable refractory materials may be employed to form the mold 36, this invention makes possible the utilization of low cost high purity quartz and the like, which is preferred for the practice of the invention for that reason.

The mold 36 includes the usual mold body 37 encasing the patterns 10, the mold pouring cup 39 defined by the sprue form flange 18 and that portion of the coating 22 covering same, and body extension 41 that is defined end 31 of sprue form shank 16 and the portion of coating 22 covering same.

With the formation of the mold 36 completed, the next step is to remove the sprue form 14, and this is accomplished by applying heat to the end 40 of the sprue form represented by the sprue form extension 20 as by employing a suitable electrical heater that is placed in contact with the form extension 20. The sprue form being formed from a material having good heat conduction properties, the heat moves the length of the sprue form and melts the portion of the coating 22 engaging the sprue form, thereby permitting the sprue form to be withdrawn from the mold, utilizing the extension 20 as a handle for this purpose. This results in the mold configuration of FIG. 5, which contains the encased patterns 10 as well as the remaining portion of the layer 22; the mold 36 now defines sprue opening 43, which extends through the mold from its pouring cup to its extension 41, at which the sprue opening is closed off by end wall 45.

The mold 36 is then arranged for the water leaching procedure which removes the layer 22 and patterns 10 from the mold without heating the mold, and preferably this is done at room temperatures.

FIGS. 6 and 7 diagrammatically illustrate one way of performing the water leaching operation in accordance with this invention, wherein a plurality of the molds 36 are applied to a leaching apparatus 40.

The leaching apparatus 40 generally comprises a suitable tank 42 containing a water bath 44 at room temperature. The tank 42 has journaled in same, for rotation about axis 47, a shaft 46, as by having the respective shaft ends 48 and 50 journaled in suitable flange type bearing units 52 and 54, respectively, that are suitably secured to the opposed sides 56 and 58 of the tank.

The shaft 46 has mounted on same a hub 64, which may be keyed to the shaft by a suitable key 66, which hub 64 has fixed thereto a mounting arm 68 having oppositely extending end portions 70 and 72 to each of which are applied a mold 36.

For this purpose the respective arm portions 70 and 72 are equipped with a fixed mounting bracket 74 and an adjusting mounting bracket 76 between which the respective molds 36 are applied in the manner indicated in FIG. 6.

In the form shown, the fixed mounting brackets 74 comprise a first leg 78 (see FIG. 6) that is suitably affixed to the mounting arm portion involved, as by employing suitable bolts 80, and a second leg 82 equipped with a pair of indexing fingers 83 and 84 adapted to receive, in the case of the mold 36 illustrated, the rim 86 of the mold pouring cup 39.

The adjustable bracket 76 comprises a first leg 90 slidably mounted in housing 92 that is suitably secured to the arm portion in question, and a second leg 94 havings its end portion 96 right angled into parallelism with the leg 90 and directed radially of the shaft 46.

The bracket 76 is biased radially in the direction of the shaft by suitable compression spring 98 interposed between the housing 92 and a suitable spring seat 100 fixed to the bracket leg 90.

Prior to mounting the mold 36 on the individual mounting arm portions 70 and 72, each mold 36 is formed with an opening 102 at the normally closed end wall 45 of the mold sprue 23, which opening 102 is proportioned not only to receive the angled end portion 96 of a leg 94 of bracket 76, but also for water drainage from the mold during the leaching operation.

It will thus be seen that the individual molds 36 may have their pour cups 39 respectively applied to the respective brackets 74 in the manner indicated in FIG. 6, and the end portions 96 of the respective brackets 76 applied to the respective mold sprue extensions 41 in the manner indicated in FIG. 6, to mount the respective molds 36 in leaching position in the apparatus 40, spring 98 of the respective molds 36 clamped between the respective pairs of brackets 76 and 76.

The shaft 46 has suitable sprocket 110 suitably keyed thereto over which is trained suitable drive chain 112 that is in turn trained over sprocket 114 keyed to suitable shaft 116 journaled in suitably bearing structure 120 that is suitably mounted on support plate 122 that is affixed to tank 42 by suitable bolts 124. Shaft 116 is driven by a suitable motor 126 through suitable gear reducer 128 which are suitably supported by mounting plate 122 (as by platform 129 suitably secured to plate 122).

In the form shown, the leaching apparatus 40 has a pair of molds 36 mounted on its mounting arm 68, and on operation of the motor 126 the shaft is rotated to consecutively immerse and remove the respective molds in the water bath 44.

As indicated in FIGS. 6 and 7, the molds 36 as mounted on the shaft 46 are spaced radially from the axis of rotation 47 of the shaft 46, and while the top level of the bath 44 is preferably below the shaft 44, the said top level is sufficiently high so that when the mounting arm 68 is in a vertical position, the lower mold is completely submerged to allow full entry of the bath water into the mold so as to fill the open spaces in same.

As a mold is lowered into the bath, the bath fluid enters the mold sprue opening 43, with air first escaping through the mold opening 102, and later through the pouring cup 39, as the mold is tilted about axis 47 to lower mold extension 45 below axis 47, at which time water also enters the mold through opening 102. As the bath water fills the mold 36, it has full and direct immersion liquid contact with that part of the layer 22 that remains in the mold, and after the layer 22 is dissolved by the water, the water has full and direct liquid immersion contact with the pattern gate sections 12, and as these are dissolved, then the patterns 10 themselves.

As the mounting arm 68 continues to rotate to bring the mold out of the liquid, the liquid drains out of the mold, initially through the opening 102, and then out through the mold pouring cup 88. This process repeats itself until the mold is free of the pattern forming material. The carbonate material, where part of the pattern forming material, at this stage assists in the pattern forming material removal by providing a scrubbing action or agitation at the surfaces of the patterns within the cavities defined by the mold, that significantly increases the rate of the pattern forming material going into solution. This is due to the formation of carbon dioxide gas when the carbonate material is exposed to water that has a low pH.

In this connection, where the chemically induced agitation is to be employed, the leaching water is to have an acidic pH, and for this purpose acid is to be added to the leaching water sufficient to reduce the water pH at least below 7.

Further, the carbonate and acid materials selected for this purpose preferably are of the types that the salts resulting from the chemical action involved are soluble in water, to facilitate recovery of the materials. Thus, acids such as sulphuric or muriatic acids should be employed as additives to the leaching water, and the carbonate additive material to the pattern forming material may be carbonates or bicarbonates of sodium, calcium (but not with sulfuric acid), potassium, and magnesium. The term carbonate as employed in the appended claims means both carbonate and bicarbonate.

After the leaching process has been completed, the mold 36 has the appearance of FIG. 8, in which its cavities 49, as well as the sprue opening 43 and pour cup 39, are fully cleared of pattern forming material for receiving the metal that is to be applied to the mold for forming the product to be formed. The opening 102 of the mold sprue is suitably plugged prior to the casting procedure.

After the individual molds 36 have been cleared of the pattern forming material, they are rinsed in fresh water and dried in an oven.

From this point on the usual procedures of investment casting may be employed to pre-heat the shells and proceed with the casting procedures. On completion of the casting procedures, the mold is broken away to expose the cast products contained within the mold cavities, one such product 130 being indicated in FIG. 9, which has a gate stub 132 that will be removed in accordance with standard procedures.

As has been pointed out, the entire leaching procedure contemplated by this invention is performed without heating the mold above room temperature. No heat is applied to the mold, in accordance with this invention until the mold is ready for drying after the leaching has been completed to remove the pattern forming material therefrom.

The leached pattern forming material is preferably recycled from the bath 44 by utilizing suitable procedures to draw off the bath water and the pattern forming material in same, and evaporate the water, as by boiling or otherwise, using agitation during the procedure to promote evaporation of the water. A preferred preliminary step of the recycling procedure is to permit some settling out of the graphite so that the graphite content of the aqueous mixture is reduced to approximately 40 percent of the pattern forming compound by weight. After the water has been evaporated the settled out graphite is returned to the pattern forming compound with the recycled pattern forming material being suitably tested and reconstituted as necessary to maintain quality control in accordance with the invention.

It will therefore be seen that the invention has a number of significant features.

For instance, the pattern forming material involved accommodates removal of same from the mold without heating the mold and by an economical water leaching procedure that permits recovery and reuse of the pattern forming material. While some synthetic resinous plastic pattern forming materials may be dissolved using chemical solvents, the basic pattern forming materials is so affected as to not be reusable, and ordinarily at least some heat treatment of the mold is required to complete removal of the pattern forming material from the mold.

Furthermore, since the mold need not be heated to higher temperatures than that required for casting, temperature gradients through the thickness of the shell are minimized, making possible the use of more inexpensive refractories, such as the aforementioned high purity quartz.

Inspection of molds made in accordance with the invention reveals that after the leaching procedure the only residue left is a light film of graphite, which is advantageous as it results in a better surface being formed in the castings, especially those formed from ferrous materials.

Another significant advantage is that in the practice of the invention the thickness of the shell can be reduced for casting purposes. The shell need only be sufficiently thick to resist pouring stresses as no stresses are set up in the shell by removal of the pattern forming material in accordance with the invention.

The leaching arrangement illustrated in FIGS. 6 and 7 is diagrammatic in nature only, the showing provided being primarily for purposes of illustrating fundamental aspects of the invention. In practice, the mounting arm 68 may have a second arm of like character at right angles to it for mounting a second pair of molds 36, and the shaft 46 may be arranged to mount a number of sets of such arms for multiple leaching of molds 36, with the bath container 42 being suitably proportioned as desired to accommodate the number of sets of mold mounting arms desired.

Where the solid investment procedure is used, the formation of the mold follows standard practice for such procedure, with the formation of the patterns, pattern assembly, and leach of the pattern material from the mold following the steps that have been described. The leaching apparatus 40 in such instance is appropriately modified to handle solid investment molds.

While the polyethylene glycol material specified is preferred because its viscosity and melting temperature permit economies in molding equipment from the standpoints of working temperatures and pressures, polyethylene glycols of higher molecular weights may be employed where the higher molding pressures and temperatures can be economically accommodated. It is also practical to use mixtures of polyethylene glycols of different molecular weights to provide a polyethylene glycol mixture of a viscosity and melting temperature comparable to the 1300–1600 molecular weight material specified.

Further examples of pattern forming materials constituted in accordance with the invention are as follows (all parts by weight, with the polyethylene glycol being referred to as PEG):

1. PEG having a molecular weight in the range of 6000–7500 45 percent and graphite 55 percent.

2. PEG having a molecular weight in the 6000–7500 range 45 percent, graphite 50 percent, and calcium carbonate 5 percent.
3. PEG of moledular weight in the 6000–7500 range 15 percent, PEG of molecular weight in the range of 3000–3700 15percent, PEG in the 1300–1600 range 15 percent, graphite 55 percent.
4. The same composition as No. 3 above except that graphite is 50 percent and including 5 percent calcium carbonate.
5. PEG of molecular weight in the 1300–1600 range 45 percent, graphite 55 percent.
6. The same composition as No. 5 above except that graphite is 50 percent and including 5 percent calcium carbonate.
7. The same composition as No. 5 above except that graphite is 50 percent and including 5 percent sodium bicarbonate.
8. PEG of molecular weight range 3000–3700 45 percent and graphite 55 percent.
9. The same composition as No. 8 above except that graphite is 50 percent and including 5 percent calcium carbonate.
10. The same composition as No. 8 above except that graphite is 50 percent and including 5 percent sodium bicarbonate.
11. The same composition as No. 2 above except that 5 percent sodium bicarbonate is used instead of calcium carbonate.
12. The same composition as No. 4 above except that 5 percent sodium bicarbonate is used instead of the calcium carbonate.
13. PEG of molecular weight in the 15,000–20,000 range 47.5 percent and graphite 52.5 percent.
14. The same composition as No. 12 above except that graphite is 47.5 percent and including 5 percent calcium carbonate.
15. PEG of molecular weight in the 15,000–20,000 range, 23.75 percent, PEG of molecular weight in the 1300–1600 range, 23.75 percent, and graphite 52.5 percent.
16. The same composition as No. 15 above except that graphite is 47.5 percent, and including 5 percent calcium carbonate.
17. PEG of molecular weight in the 1300–1600 range 45 percent, graphite 54 percent and one percent calcium carbonate.

As indicated, where mechanical agitation will suffice for efficient leaching of the pattern forming material, the carbonate materials may be omitted therefrom. Alternately, under some conditions mechanical agitation may be dispensed with, and the indicated chemical agitation employed, by keeping the leaching water pH under 7, and selecting acid and carbonates for this purpose so that the resulting salts will be water soluble, as hereindisclosed.

Calcium carbonate is preferred for use in the pattern forming material as it is inexpensive, readily available, and does not cake when supplied in the finely ground form desired for practice of the invention. Whatever carbonate is employed should be finely ground (on the order of 200 mesh) and widely dispursed throughout the polyethylene glycol and graphite materials employed.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. The method of making a mold for investment casting utilizing a sprue form and a pattern formed with a gate section, said method comprising:

forming the pattern and gate section from, and coating the exterior of the sprue form with, a mixture of polyethylene glycol having a molecular weight that is at least in the range having as the lower limit approximately 1,300 to approximately 1,600 and having as the upper limit 15,000 to 20,000, and powdered graphite, wherein the graphite comprises in the range of approximately 35 to approximately 60 percent by weight of the mixture, adhering the pattern gate section to the sprue form coating at a location on the sprue form spaced from one end of the sprue form, encasing the said pattern and sprue form, to the exclusion of said sprue form one end, with mold forming material to form an investment mold, whereby said one end of the sprue form is exposed from the thus formed mold, heating the sprue form from said one end thereof to melt the sprue form coating, removing the sprue form from the mold to define the mold sprue opening and expose the portion of the pattern gate section, that was adhered to the sprue form coating, to said mold sprue opening, water leaching the gate section and the pattern from the mold at room temperature to form in the mold a mold investment cavity and a channel communicating between the cavity and the mold sprue opening, and drying the mold.

2. The method set forth in claim 1 wherein:

the leaching step is performed by repeatedly applying water into the mold sprue opening and draining same therefrom.

3. The method set forth in claim 1 wherein:

the leaching step is performed by intermittently moving the mold into and out of a water bath with the mold sprue opening disposed to permit water drainage therefrom when the mold is moved out of the bath.

4. The method set forth in claim 3 including:

processing the bath to recycle the pattern forming mixture contained in the bath.

5. The method set forth in claim 1 wherein:

the viscosity and melting temperature of the mixture approximates the viscosity and melting temperature of a mixture of polyethylene glycol having a molecular weight in the range of from approximately 1300 to approximately 1600, and powdered graphite, in approximately equal amounts by weight.

6. The method set forth in claim 1 wherein:

said mixture includes a carbonate in finely divided condition in an amount lying in the range of about 1–5 percent by weight, and wherein the leaching water is maintained at a pH of less than seven by the addition of an acid thereto, with the carbonate and acid being selected from materials whereby the resulting salt is water soluble, whereby on practicing the leaching step a chemical agitation of the leaching water at the surfacing of the gate section and pattern is effected.

7. The method of making a multiple cavity mold for investment casting utilizing a sprue form and plurality of patterns each formed with a gate section, said method comprising:

forming the patterns and the gate sections from, and coating the exterior of the sprue form with, a mixture of polyethylene glycol having a molecular weight that is at least in the range having as the lower limit approximately 1,300 to approximately 1,600 and having as the upper limit 15,000 to 20,000, and powdered graphite, wherein the graphite comprises in the range of from approximately 35 to approximately 60 percent by weight of the mixture, adhering the gate sections of the patterns to the sprue form coating at a location on the sprue form spaced from one end of the sprue form and in a uniform spacing about the sprue form, encasing the said patterns and sprue form, to the exclusion of said sprue form one end, with mold forming material to form an investment mold whereby said one end of the sprue form is exposed from the thus formed mold, heating the sprue form by applying heat to said one end thereof to melt the sprue form coating, removing the sprue form from the mold to define the mold sprue opening and expose the portions of the respective pattern gate sections, that were adhered to the sprue form coating, to the resulting mold sprue opening, water leaching the gate sections and the respective patterns from the mold at room temperature, to form in the mold its investment cavities and a channel for each such cavity communicating between the respective cavities and the mold sprue opening, and drying the mold.

8. The method set forth in claim 7 wherein:

the leaching step is performed by intermittently moving the mold in and out of a water bath with the mold sprue opening disposed to permit water movement into and out of the sprue opening for leaching engagement with the patterns and their respective gate sections.

9. The method set forth in claim 8 wherein:

for performing the leaching step the mold is rotated about a horizontal axis disposed adjacent the bath level, with the mold being radially spaced from adjacent said axis.

10. The method set forth in claim 7 wherein:

the mixture is approximately 50 percent polyethylene glycol and 50 percent graphite by weight.

11. The method set forth in claim 10 wherein:

the graphite comprises approximately 35 percent by weight of mesh 200 particle size and approximately 65 percent of mesh 35 particle size.

12. The method set forth in claim 9 wherein:

the sprue form is shaped to form the mold sprue opening to extend through the mold and define a closed end wall at the inner end of same, and prior to performing the leaching step, the sprue end wall is opened for passage of the leaching water therethrough.

* * * * *